United States Patent [19]

Forsythe

[11] 4,076,562

[45] Feb. 28, 1978

[54] EXPLOSIVE COMPOSITION WITH ADHERED AIR ENTRAPPING MATERIAL

[76] Inventor: Richard Wells Forsythe, 13601 Preston Road, Carillon Tower, Ste. 815W, Dallas, Tex. 75240

[21] Appl. No.: 739,282

[22] Filed: Nov. 5, 1976

[51] Int. Cl.[2] ..... C06B 45/34

[52] U.S. Cl. ..... 149/7; 149/47; 149/62; 149/76; 149/89

[58] Field of Search ..... 149/89, 3, 47, 7, 62, 149/76

[56] References Cited

U.S. PATENT DOCUMENTS

| | | | |
|---|---|---|---|
| 3,718,512 | 2/1973 | Hurst | 149/89 X |
| 3,830,672 | 8/1974 | Lista | 149/7 |

*Primary Examiner*—Stephen J. Lechert, Jr.

*Attorney, Agent, or Firm*—Hubbard, Thurman, Turner, Tucker and Glaser

[57] ABSTRACT

Explosive compositions, sensitive to a number six blasting cap, comprise a liquid, highly combustible fuel and supported air entrapment material in an amount such that from about one to about 95 volume percent of the total explosive mixture is air.

38 Claims, No Drawings

EXPLOSIVE COMPOSITION WITH ADHERED AIR ENTRAPPING MATERIAL

BACKGROUND OF THE INVENTION

This invention relates to improved, explosive compositions. In another aspect, this invention relates to improved explosive compositions comprising readily available, highly combustible liquid fuels and a supported air entrapment material. In yet another aspect, this invention relates to a method for rendering highly combustible liquids explosive and sensitive to a number six blasting cap, by combining the liquids with supported air entrapment materials.

Explosive compositions are widely used in our industrial society. Probably the best known explosive composition is dynamite, which was invented by Nobel. Dynamite utilizes a very dangerous precursor material, namely liquid nitroglycerin, which is already a cap-sensitive explosive, and thereafter, combines it with various fillers to make it a relatively safe material to handle. However, the production and handling of dynamite is still hazardous because to the highly explosive nature of the dynamite components.

Many alternative explosive compositions have been suggested to replace dynamite and other hazardous explosives. For example, relatively safe materials, such as nitroparaffins and the like, have been found to be easily sensitized to become excellent performing explosives with high power and energy release. Nitroparaffins, such as nitromethane, can be rendered cap-sensitive by several approaches, including the addition of microspheres of entrapped air in a gel of the nitroparaffins, such as is disclosed in Minnic, U.S. Pat. No. 3,338,165. This approach may produce a cap-sensitive explosive composition, but it has been found that gels are very difficult to produce and do not remain stable under long term storage conditions or under temperature fluctuations, as may be expected in some field operations.

Other approaches for rendering materials such as nitroparaffins cap-sensitive have been to incorporate air entrapment materials, such as microspheres and the like in a foam precursor system, followed by a foaming step. After the foam has been sufficiently cured, nitroparaffins can be added to the foam. This approach has been suggested by such references as Chandler, U.S. Pat. No. 3,794,534, and Eckels, U.S. Pat. No. 3,797,392. These approaches for producing explosive compositions have not met with commercial success on a wide scale because of the extreme difficulty in production of the foamed materials having evenly distributed air entrapment materials therein. In many instances, materials made by these processes will not even detonate. Additionally, when detonation can be achieved, there is very little reliability in the performance of such compositions.

Many other methods have been suggested for rendering combustible liquids, such as nitroparaffins, capsensitive, including the addition of nitroparaffins to finely ground materials such as carbonaceous materials, oxidizer materials, such as ammonium nitrate and the like. Many different references, such as Hearst, U.S. Pat. No. 3,718,512, Davidson, U.S. Pat. No. 2,892,377, and others, discuss the advisability of finely grinding materials such as ammonium nitrate and thereafter very closely and precisely controlling the amount of a nitroparaffin, such as nitromethane, that is added to the finely ground ammonium nitrate material. While such mixtures can be utilized for explosive materials, many problems and disadvangtages are connected with such teachings in the prior art. For example, the amount of the nitromethane that is added to the composition must be very closely controlled. Additionally, such compositions do not store well and will lose their sensitivity over reasonable periods of storage. In fact, many of the explosives must be field prepared utilizing relatively time-consuming procedures. It has also been found that such explosive materials, even when they can be successfuly prepared and detonated, do not have extremely high levels of explosive energy, thereby requiring the use of additional pounds of explosive to achieve a desired result.

Methods for sensitizing nitroparaffins by the addition of various soluable amines and acids have also been suggested by numerous references in the prior art. These explosives are very powerful and efficient but, unfortunately, they all lack long-term storage stability and must be used within a matter of a few hours or a few days after mixing.

In view of the foregoing, it is highly desirable to produce an inexpensive and easily prepared explosive composition from highly combustible, safe liquid materials and other inexpensive solid materials. The inventor is well aware of the problems of prior art explosive compositions and is well aware of the need for the production of inexpensive explosive compositions that can be safely and easily prepared and stored over a long period of time without losing their sensitivity to detonation.

SUMMARY OF THE INVENTION

Accordingly, it is an object of this invention to provide improved explosive compositions from readily available and inexpensive starting materials. It is another object of this invention to provide improved explosive compositions from materials such as nitroparaffin that can be detonated with a number six blasting cap to produce uniform and reliable explosive energy, even when prepared and stored for long periods of time under varying conditions. It is also another object of this invention to produce explosive compositions from a variety of materials whereby the density of the explosive composition can be varied over wide ranges without significant loss of explosive energy from the composition. It is yet another object of this invention to provide a method for rendering highly combustible liquid materials explosive by combining such liquid materials with a solid material.

It has been found that highly combustible liquid materials can be utilized to produce explosive compositions by combining the liquid materials with a solid material that supports evenly distributed air entrapment materials in an amount sufficient to provide from about one to about 95 percent by volume of air based on the volume of the explosive mixture. The solid component of the explosive compositions of this invention have the air entrapment materials affixed to the surface of the solid component in such a manner that the air entrapment materials remain firmly and rigidly in place even when the highly combustible, liquid component is added to and remains in contact with the solid component for long periods of time. In producing the explosive compositions of this invention, the solid component is preferably in the form of discrete particles and the air entrapment materials, also in the form of discrete particles, is combined with and thoroughly admixed with such discrete particles of solid material in the presence of an adhesive material to firmly affix the air entrapment materials to the surface of the solid component. When the adhesive material cures, the air entrapment component is firmly held on the surface of the solid component and thereafter, the highly combustible liquid material can be added to the thus supported air entrapment material.

DESCRIPTION OF PREFERRED EMBODIMENTS

The improved explosive compositions of this invention include a highly combustible liquid fuel in contact with an air entrapment material that is adhered to the surface of a solid component. The air entrapment material is adhered to the surface of the solid component by thoroughly admixing, or dispersing, the air entrapment material with the solid component in the presence of an adhesive material so as to affix or attach the air entrapment material to the surfaces of the solid component uniformly throughout the mass of the mixture.

In preparing the portion of the explosive composition of this invention that includes the solid component and the air entrapment materials, any means known in the art for uniformly mixing or dispersing air entrapment materials throughout the solid component can be utilized. It has been found to be particluarly advantageous to utilize solid components that are discrete particles, such as ground granular particles, and the like, and to mix such discrete particles with the air entrapment materials. It will be appreciated that the air entrapment materials are also preferably discrete particles that can be uniformly dispersed throughout the mass of the mixture. Either after or during the complete dispersion of the air entrapment materials throughout the solid component, a suitable adhesive material is added to the mixture to at least partially bond the air entrapment materials to the surfaces of the solid components to adhere or stick the air entrapment materials to the surfaces of the solid components. Thereafter, the mixture of the air entrapment materials, the solid components and the adhesive components is cured to produce a relatively porous mass having the air entrapment materials affixed to the surface of the solid component.

In carrying out the production of the portion of the composition of this invention that includes the solid component and the air entrapment material, it has been found to be particularly preferred to combine the solid component with the air entrapment material and tumble the combination in a rotary tumbler, a ribbon mill, or the like, to produce a uniform and complete dispersion of the air entrapment material throughout the solid component. As soon as the air entrapment material and the solid components have been thoroughly admixed together, a small amount of suitable adhesive material can be added to the mixture, preferably while the mixture is being tumbled, to at least partially coat the discrete particles of the air entrapment material, whereby the air entrapment materials will stick to and become affixed to the surfaces of at least the adjacent particles of the solid component in the mixture. Thereafter, the thoroughly admixed mixture is cured, thereby resulting in the air entrapment materials being firmly affixed to the surfaces of at least a portion of the discrete particles of the solid components throughout the mixture. It will be appreciated that only a small amount of the adhesive mixture is necessary for the coating step in that it is important to have a relatively porous, cured structure whereby the combustible liquid fuel can permeate and be intimately contacted with substantially all of the discrete particles of the solid component and the air entrapment material to produce the explosive compositions of this invention.

The highly combustible liquid that is utilized in this invention can be virtually any liquid that will undergo self-sustained combustion in air. The more sensitive explosive compositions made in accordance with this invention are made from combustible liquids that are highly volatile. Suitable examples of combustible liquids that can be utilized to produce the explosive compositions of this invention include organic materials that are liquid under atmospheric conditions and at temperatures of from about 0° C to about 50° C. It will be appreciated that the combustible liquid fuel must be a liquid under the conditions of use to thereby insure an intimate contact with the supported air entrapment materials. Therefore, low molecular weight hydrocarbons, oxygen containing materials such as ketones, ethers, esters, acids, and the like, as well as nitrogen containing organic materials, halogenated organic materials and the like. Organic materials that are extremely volatile under the conditions of use may be difficult to handle and may pose some safety problem, although they function very well to produce the explosive compositions of this invention. It has been found to be particularly preferred to utilize nitroalkane materials as at least a portion of the combustible liquid component of this invention. Nitroalkane materials, such as nitromethane, nitroethane, nitropropane and the like, are extremely useful combustible liquid materials for use in this invention. Other useful combustible liquid materials include aromatic hydrocarbons, such as benzene, toluene, xylene, and the like. Aliphatic hydrocarbons, such as propane, butane, pintane, hexane, heptane, octane, and the like, are also useful. Combustible, low molecular weight ethers, esters and ketones, are also very useful as the liquid combustible material component of this invention. Ethers such as diethylether, dipropylether, dibutylether, and the like, as well as ketones, such as methylethyl ketone, diethyl ketone, dipropyl ketone, dibutyl ketone, and the like, are also extremely useful. The combustible liquid component of this invention can be comprised of a mixture of various combustible materials, such as mixtures of nitromethane with other components, such as 1-nitropropane, 2-nitropropane, methanol, chlorinated hydrocarbons and the like. It has been found that any liquid that is miscible with the nitroalkanes can be present so long as the mixture is still combustible in air on a self-sustaining basis. Other combustible liquids, such as gasoline, kerosene, fuel oils and the like, can also be utilized as the liquid component in this invention.

The most preferred combustible liquid materials that are utilized in this invention are those combustible liquids that include nitroalkanes, such as nitromethane, nitroethane, nitropropane and the like.

While virtually any combustible liquid material can be utilized in this invention, the most preferred combustible liquids include at least about 80% nitroalkanes. Nitromethane compositions wherein the nitromethane is present in an amount of at least 80%, is the most preferred liquid component utilized in this invention.

The air entrapment material that is utilized in this invention can be any relatively closed cell material that will entrap and contain air when it is submerged in the liquid component as described above. Thus, small, hollow glass or ceramic microspheres, ground cork, fumed silica, wood pulp, sawdust, and the like, can be utilized as the air entrapment material. Particularly preferred air entrapment materials are the microspheres that are made up of very small, hollow glass or hollow ceramic structures that will trap and contain air therein. Microspheres are well known in the art and are commercially available from many manufacturers. The preferred sizes of the microspheres vary over a wide range. Preferably, however, the size of the microspheres will be from about 10 microns up to about one-quarter inch in average particle diameter. By utilizing such small microspheres, it is possible to evenly disperse the microspheres throughout the mixture of the solid components and adhere the individual microspheres to surrounding discrete particles of the solid component. Preferably, the air entrapment materials should be of such a structure as to contain air pockets or air chambers having a mean diameter of from about one micron up to one-quarter inch. As previously mentioned, the structure of the air entrapment materials should be such that the discrete air chambers are closed chambers whereby the conbustible liquid material will not flood the chambers and displace the air from such chambers. Therefore, it will be appreciated that, in some instances, special care should be taken to avoid undue rupture or collapse of the individual air chambers while the air entrapment material is being blended with and adhered to the surface of the solid component. Additionally, care should be taken during the actual loading of the explosive composition into containers and during storage and shipment of the containers to avoid rupture and collapse of the air chambers.

The composition of the solid component that is utilized in the instant invention in some instances will depend on the composition of the combustible liquid component. In those instances wherein the liquid combustible material is a highly volatile combustible material such as a nitroalkane, a low molecular weight ether, a low molecular weight hydrocarbon, a low molecular weight ketone or ester, virtually any solid material that will not undergo a reaction with or be dissolved in the liquid component of the composition can be utilized. Thus, solid materials such as very stable inert granular substances, such as sand, limestone, lime, iron filings, aluminum shavings, ground or chopped polymeric foams and the like, can be utilized as the solid component onto which the air entrapment materials are bonded.

In addition to the above-mentioned relatively inert solid components that can be utilized for attaching or adhering the air entrapment components thereto, other solid materials that at least partially enter into the explosive reaction can be used. Such oxidizing salt materials as alkali metal and alkaline earth metal, nitrates, as well as ammonium nitrates and perchlorates, are some of the preferred solid material components that are utilized in the instant invention. In those instances where the combustible fuel material is not one of the foregoing low molecular weight materials or a nitroalkane material, at least a portion of the solid component of the composition must be one of the foregoing oxidizing salts.

The most preferred solid materials that are utilized in the instant invention for supporting and adhering the air entrapment materials to the surface thereof are the nitrate materials such as ammonium nitrate, sodium nitrate, potassium nitrate and the like. These materials are relatively inexpensive and add to the explosive efficiency of the total composition because they enter into the explosive reaction along with the combustible liquid material.

It has been found that the solid component, onto which the air entrapment materials are bonded, are preferably granular or finely divided solid components to aid in the complete and uniform dispersion of the air entrapment materials through the composition. Therefore, the preferred particle size of the solid component will be up to about one-quarter inch in mean particle diameter to insure the complete dispersion of the air entrapment materials throughout the mixture. While the preferred solid components for producing the explosive composition of this mixture are in the form of discrete particles to insure complete dispersion of the air entrapment materials throughout the composition, it is within the scope of this invention to utilize other solid materials such as steel wool, thin layers of fabric, filaments and the like, for adhering the air entrapment materials thereto in a uniform and completely dispersed arrangement. It will be appreciated, however, that the most convenient method for adhering and dispersing the air entrapment materials throughout the composition and for supporting those air entrapment materials in the uniformly dispersed arrangement will be by stirring, tumbling or otherwise agitating discrete solid component particles in the presence of the air entrapment particles and in the presence of a suitable adhesive for forming the bond between the air entrapment particles and the solid component particles.

The adhesive component that is utilized for adhering and supporting the air entrapment component onto the surfaces of the solid component of the composition can be any suitable adhesive that will cure into a system that will not be soluable in the liquid combustible component and will be inert to such liquid combustible component. As previously mentioned, it is important that the adhesive material will cure into a structure that will firmly support and adhere the air entrapment components to the surface of the solid material components in the composition. The adhesive composition can be any adhesive known in the art that will cure into a structure that is insoluable in the combustible liquid of the composition and will not undergo reaction therewith. In the case of combustible liquid compositions that include nitroalkanes, such as nitromethane and its homologs, the well known urethane adhesives are quite useful. Thus, polyisocyanates, which may be used alone or in mixtures with rubber, or the reaction products ("prepolymers") of an excess of a polyisocyanate with an organic compound containing two or more active hydrogen groups, such as polyesters and glycols, and polymeric compounds containing active hydrogen groups that have been modified by reaction with a polyisocyne are quite beneficial for adhering the air entrapment materials to the surfaces of the solid components of this invention. In practice, a solution of the polyisocyanate and other reactants of the adhesive system, if needed, can be added to an intimate admixture of the air entrapment material and the solid components. Thus, by tumbling, stirring, or otherwise mixing the mixture of the air entrapment material and the solid components with the adhesive component, at least a portion of the air entrapment component particles.

The molecular weight of the adhesives used in the instant invention is not particularly important so long as the adhesive is capable of bonding and supporting the air entrapment material to the surface of the adjacent solid component of the composition. Therefore, in isocyanate adhesive, which includes polymers of low to moderate molecular weight containing free isocyanate groups is particularly preferred. Reaction with water will lead to a chain lengthening or cross linking of the adhesive precursors. Polyhydroxy compounds used in preparing a suitable prepolymer adhesive may be polyethers, polyesters, caster oil, glycol or related materials.

In preparing the compositions of this invention, the solid component, such as finely ground solid materials, will be mixed with the air entrapment materials in such an amount that the final composition will have an entrapped air volume of from about one to about 95 volume percent. Preferably, however, the air entrapment material will be added in an amount to produce a final composition having an entrapped air volume of from about five to about sixteen volume percent of the entire composition.

The amount of adhesive material that is added to the solid component and the air entrapment material to produce the supported and bonded air entrapment material on the surface of the solid component will be an effective amount up to about fifteen weight percent of the total of the solid material and the air entrapment material. Preferably, however, the amount of adhesive will be in the range of about 0.5 weight percent up to about six weight percent with the most preferred range being about one percent to about four weight percent of the total weight of the air entrapment material and a solid component. The adhesive material should not be added in such a volume as to completely seal or obstruct the liquid passages and voids within the structure of the solid component with the supported air entrapment materials. The explosive composition functions by the combustible liquid material at least partially wetting the outer surfaces of the air entrapment material, thereby requiring intimate contact between the combustible liquid component and at least a portion of the air entrapment particles in the composition.

Once the air entrapment particles have been bonded to and supported by the solid component of the composition, this dry mixture can be conveniently loaded into suitable storage containers or containers that will be ultimately used to contain the explosive compositions. In some instances, it may be desirable to add the thoroughly admixed air entrapment material, solid component and adhesive mixture to such containers before the adhesive has finally cured. In some instances, the mixture can then cure within the container to produce a relatively porous solid structure that will receive and contain the liquid component of the explosive mixture at some later time. In some instances, however, it may be desirable to allow the mixture of the adhesive, the air entrapment material and the solid component to at least partially cure before adding it to storage containers or containers that will ultimately contain the explosive composition. If the composition tends to cake or aglomerate, it may be necessary to at least partially fragment or break apart the dry mixture prior to adding it to the storage containers or the containers that will contain the explosive composition. Care must be utilized not to unduly crush or collapse the walls of the air chambers within the structure.

The explosive composition is prepared for detonation by pouring, or otherwise mixing, the combustible liquid material with the air entrapment material that is supported by and held in place by the solid components. Normally, the structure will be relatively porous and the combustible liquid can be poured into a container that holds the supported air entrapment materials. The combustible liquid will displace all of the air contained within the interstitual voids of the composition but it will not displace the air contained within the air entrapment particles. The amount of combustible liquid that will be added to the supported air entrapment particles that are supported and held in place by the solid component will be in an amount of from about three to about 96 weight percent of the entire composition. Preferably, the combustible liquid will be added in an amount of from about 25 to about 50 weight percent of the entire composition. It will be appreciated that when the combustible liquid is added to the supported air entrapment materials in such amounts, the liquid will, in some cases, completely displace and saturate the entire solid mixture whereby there is no air contained within the composition except within the individual air chambers of the air entrapment material.

It has been found that the instant explosive compositions can be conveniently prepared for detonation by simply submerging a container containing the supported air entrapment materials in a bath of the combustible liquid material to completely saturate the composition. Thus, the explosive compositions can be very quickly and easily prepared in the field without the necessity of a tedious and time consuming measuring of the liquid combustible material.

It has been found that the instant explosive compositions have an indefinite shelf life and remain effective over long periods of time even when the combustible liquid material is added to the supported air entrapment material. Additionally, it has been found that the instant explosive compositions are not susceptible to decomposition normally associated with other types of explosive compositions when they are transported over a long distance or subjected to harsh handling and shipment or storage.

It will be appreciated that the instant invention can be utilized to produce explosive compositions having different densities. Thus, in a composition using nitroalkanes as the combustible liquid material, by properly selecting the solid material to support and adhere the air entrapment materials thereto, a wide range of densities of explosive compositions can be prepared. For example, if the solid material is a lightweight ground foam material, the resulting explosive composition will have a relatively low density. Conversely, when the solid material is a relatively heavy or dense material such as a granulated, barite material, metal filings or the like, the density of the explosive composition will be very high.

The following examples are presented to illustrate embodiments of the present invention. The examples are given for illustrative purposes only and are not intended to limit the scope of the invention.

In the following series of tests, various explosive compositions of the prior art, as well as explosive compositions of this invention were tested for brisance comparisons and for degree of sensitivity comparisons. The brisance tests were all carried out by placing a substantially identical amount of the explosive in a polyvinyl chloride container having an inside diameter of approximately one and one-fourth inch and a height of three inches with a uniform wall thickness of 0.05 inches. The explosive charge, contained in the polyvinyl chloride container was placed upright in the center of a cold, rolled steel plate three inches by three inches and three-quarters of an inch thick with the steel plate resting on a solid foundation. A burning fuse #6 blasting cap was inserted into the top of the container with the cap being inserted one-fourth inch into the explosive composition. The blasting cap was detonated and, if the explosive contained within the polyvinyl chloride container fired, the depth of the dent in the steel plate was measured with a depth micrometer to indicate the shock energy delivered into the target steel plate. The sensitivity comparative tests were all run by placing an equal amount of the explosive composition to be tested in a polyvinyl chloride container as indicated above. Following loading of the explosive into the container, one plastic card having a diameter of two inches by two inches by 0.01 inch thick, was placed flat on the top of the plastic container. A #6 blasting cap was taped against the top of the plastic card with the explosive end of the cap firmly against the top of the plastic card and the center lines of the explosive charge were centered above the plastic container containing the explosive composition. The cap was detonated and, if the explosive composition within the plastic container detonated, the test was repeated with the addition of one card until the charge failed to detonate. A comparison of the number of cards at which each test composition failed to detonate compares the relative sensitivity of the explosive compositions.

EXAMPLE 1

A plastic test container was completely filled with duPont Chemical Co. 60% Red Cross dynamite, the brisance test conducted, and a plate dent of 0.024 inches measured. Eight test samples of the 60% dynamite were then prepared in test containers, card gap sensitivity tests conducted and the "cut-off" was at 42 cards or 0.420 inches.

EXAMPLE 2

The brisance experiment of Example 1 was repeated twice using duPont Chemical Co. Red Arros 70% dynamite and duPont Chemical Co. High Drive 85% dynamite and plate dents of 0.020 inches and 0.013 inches were measured. No sensitivity tests were conducted since the 70% and 85% dynamites are more sensitive than the 60%. (See Table 1).

EXAMPLE 3

A polyurethane foam containing glass bubbles was prepared by thoroughly mixing the following materials:

| | Parts/Mixture |
|---|---|
| Polyol | 100 |
| Water | 3 |
| Stannous Octoate | 1 |
| Blowing agent | 10 |
| Bubble size controller | 2 |
| Toluene Diisocyanate | 58 |
| Glass bubbles | 70 |

This mixture was reacted and then placed in a 300° F. oven for about 5 minutes thereby producing a polyurethane foam having glass bubbles dispersed therein.

The polyol used was a triol having a molecular weight of 3500 and a hydroxyl number of 50.

The blowing agent used was a liquid mixture of fluorochloroalkanes.

The bubble-size controller was a silicone surfactant marketed by Dow-Corning Corporation under the designation DC-193.

The glass bubbles had an average true particle density between 0.30 and 0.34 gm/cc and bulk density of about 0.19 gm/cc. The average size of the particles is between 20 and 200 microns.

In the above formula, the 3g. of water reacts to form 7.3 g. of carbon dioxide and the propellant is volatile. The total weight of the glass bubbles and the total foamed polyurethane is therefore 217 gm. The percentage of the volume of the glass bubbles was about 6%. The density of the foam was approximately 0.05 gm/cc.

A cylinder about 1¼ inch in diameter and 3 inches long was cut to fit a plastic container and was inserted therein. The container was then filled to the top of the foam with nitromethane. It was determined that the glass bubbles occupied approximately 6% by volume of the container and the nitromethane occupied 85%. The brisance test was conducted on a steel plate. When the cap detonated the charge exploded. A micrometer measurement of the dent in the steel plate indicates a dent of 0.077 inches in maximum depth.

Out of the same batch of foam, eight more samples were tested in the sensitivity test to determine the card gap sensitivity cut-off point. The samples detonated until two plastic cards were placed between the cap and the composition whereupon the cap detonated and the composition did not fire.

EXAMPLE 4

The experiment of Example 3 was repeated in all essential details 10 times. The weight of the foam ingredients was kept constant for each of the 10 batches mixed, however, the percent microsphere volume divided by the total container volume varied due to different foam curing results. Detonations occurred 8 times with plate dents measured as 0.48 inches; 0.052 inches; 0.055 inches; 0.06 inches; 0.071 inches; 0.077 inches; 0.086 inches and 0.091 inches. These runs show the inconsistency of conventional foamed explosives.

EXAMPLE 5

Polyurethane foam scrap was obtained from a cushion manufacturer. It was ground into particles and screened to remove particles having dimensions greater than ½ inch by ½ inch. Into a small 60 rpm lab mixer was delivered 8 gm of the ground foam and 6.5 gm of glass bubbles of between 20 and 200 micron size. The mixer was turned on and the contents were sprayed with 4 gms of a polyurethane prepolymer having a 8–10% free isocyanate groups. The mixture was turned out of the mixer and placed into a plastic test container while the prepolymer cured. The product was a rebonded foam. The test container was submerged in nitromethane such that the voids of the test mixture filled complete with the nitromethane. The glass bubbles were 10% by volume and the nitromethane occupied 85% by volume. Ten of the containers were prepared in an identical procedure and brisance and sensitivity measures made. When a #6 cap detonated the explosive a dent of 0.094 was produced in the steel plate. Sensitivity tests resulted in a no detonation with three cards. (See Table 1.)

EXAMPLE 6

Ammonium nitrate was ground to fine particles such that it was all between 10 and 425 microns in diameter. The standard plastic test container was filled with 43 grams of the ammonium nitrate. The container was flooded with nitromethane (33.8 grams). A #6 blasting cap was immersed ¼ inch into the composition and detonated. The formulation failed to detonate.

EXAMPLE 7

The composition of Example 6 was remixed except that glass microspheres of 0.3 gm/cc true particle density and between 20 and 200 microns in size were thoroughly mixed into the ammonium nitrate powder before flooding with nitromethane. The quantity of microspheres was such that the volume of the microspheres represented 10% of the total test container volume. The container was stored for two weeks, during which time numerous microspheres floated to the surface. A #6 blasting cap was immersed ¼ inch into the composition and detonated. The composition detonated partially. There was no measurable dent in the steel plate.

EXAMPLE 8

A mixture was prepared of 40 gm. of ground ammonium nitrate such that the particle sizes were between 100 and 500 micron diameter and 2.3 gm. of glass microspheres which had a particle density of 0.3 gm/cc and average particle diameters between 20 and 200 microns. The compounds were thoroughly mixed and then 1.3 gm of polyurethane prepolymer was sprayed onto the mixture and thoroughly blended in a 60 rpm lab mixer for five minutes. The mixture was packed into a plastic test container and allowed to cure for 24 hours. The container was then submerged into nitromethane such that the void space filled completely with 35 gm. nitromethane. Ten samples were prepared in an identical procedure. A brisance test was conducted by placing one #6 blasting cap ¼ inch into the composition. When the cap detonated the explosive charge detonated and produced a dent in the steel plate of 0.115 inches. Sensitivity tests were then conducted with the other test vials and a "no fire" occurred with ten cards.

EXAMPLE 9

Experiment of example 8 was repeated except that instead of submerging the test container filled with the ground ammonium nitrate, prepolymer and microspheres, a total of 10.8 gm of nitromethane was poured into the test container such that the nitromethane represented approximately 20% by weight of the explosive composition. When the composition was detonated with a #6 blasting cap, a dent in the steel plate of 0.065 inches was observed.

EXAMPLE 10

The experiment of example 8 was repeated in all essential details except that 8.1 gm of nitroethane was added to the solid mixture in place of nitromethane. When the #6 blasting cap detonated, the explosive charge detonated and produced a dent in the steel plate of 0.040 inches.

EXAMPLE 11

The experiment of example 8 was repeated in all essential details except that 4.8 gm of 2-nitropropane was added to the solid mixture in place of nitromethane. When the #6 blasting cap detonated, the explosive charge detonated and produced a dent in the steel plate of 0.039 inches.

EXAMPLE 12

The experiment of example 8 was repeated in all essential details except that 4.8 gm of 1-nitropropane was added to the solid mixture in place of nitromethane. When the #6 blasting cap detonated, the explosive charge detonated and produced a dent in the steel plate of 0.025 inches.

EXAMPLE 13

A mixture was prepared of fertilizer grade ammonium nitrate prills (not ground) and glass microspheres. The ammonium nitrate prills varied between 0.03 inches in diameter and 0.18 inches in diameter. The microspheres were of a particle density of 0.3 gm/cc and had average particle diameters between 20 and 200 microns. A total of 2.3 gm of the microspheres were thoroughly mixed with 37.3 gm of the ammonium nitrage prills. A total of 1 gm of polyurethane prepolymer was sprayed onto the mixture and thoroughly blended for five minutes. The total solid composition was poured into a plastic test container and allowed to cure for 24 hours. The container was then submerged into nitromethane such that the void space was completely filled with approximately 33 gm of nitromethane. When the #6 blasting cap detonated, the explosive charge detonated and produced a dent in the steel plate of 0.065 inches. Sensitivity tests resulted in a "no fire" with five cards.

EXAMPLE 14

The experiment of example 8 was repeated in all essential details except that in place of ammonium nitrate, the solid particles consisted of 100% inert silicone carbide. When the #6 blasting cap detonated, the explosive charge detonated and produced a dent in the steel plate of .028 inches.

EXAMPLE 15

The experiment of example 8 was repeated in all essential details except that in place of the ammonium nitrate, the solid component was a mixture of 26 gm of sodium nitrate and 38 gm of inert silicone carbide. When the #6 blasting cap detonated, the explosive charge detonated and produced a dent in the steel plate of 0.048 inches. Sensitivity tests resulted in a "no-fire" with ten cards.

EXAMPLE 16

A mixture was prepared of 50 gms of finely ground calcium oxide with 2.3 gms of glass microspheres added which had a particle density of 0.3 gm/cc and average particle diameters between 20 and 200 microns. The compounds were thoroughly mixed and then 1.0 gram of polyurethane prepolymer was sprayed onto the mixture and again thoroughly mixed. The mixture was packed into a plastic test container and allowed to cure for 24 hours. The container was then submerged into nitromethane such that the void space filled completely with 46 gm of nitromethane. When the #6 blasting cap detonated, the explosive charge detonated and produced a dent in the steel plate of 0.030 inches. Sensitivity tests resulted in a no detonation with one card.

EXAMPLE 17

The experiment of example 8 was repeated two times except that 10 gm of aluminum fines of particle diameter less than 200 microns were added to the ammonium nitrate mixture before the microspheres and prepolymer were added. In another experiment, 10 gm of magnesium fines of particle diameter less than 400 microns were added to the ammonium nitrate prior to the addition of the microspheres and prepolymer. In the brisance test, detonations with a #6 cap were achieved in both experiments.

EXAMPLE 18

The experiment of example 8 was repeated three times in all essential details except that enough group cork, fumed silica (expanded low density silica) or wood pulp were substituted, respectively, for the glass bubbles to provide 8% by volume entrapped air. The containers detonated in every instance, when initiated by a #6 cap.

EXAMPLE 19

The experiment of example 16 was repeated two times except that barium sulfate and sodium chloride were substituted, respectively, for the limestone. Detonations with a #6 cap were acheived in both instances.

EXAMPLE 20

The experiment of example 8 was repeated seven times except that sodium nitrate, potassium nitrate, sodium perchlorate, potassium perchlorate, calcium perchlorate, and ammonium perchlorate were substituted, respectively, for the ammonium nitrate. Detonations with a #6 cap were achieved in every instance.

EXAMPLE 21

A sheet of non-woven absorbent cotton ¼ inch thick 3 inches wide and 4 inches long was sprayed with 2% by weight of a polyester type polyurethane prepolymer having a 8–10% isocyanate groups. 10% by volume glass bubbles as described in Example 8, were then sprayed onto the cotton sheet such that the bubbles penetrated the sheet and product was allowed to stand until the adhesive cured. It was then loosely rolled and cut to fit a container. After inserting in the container, it was filled with nitromethane. Detonation was acheived with a #6 cap.

EXAMPLE 22

The experiment of example 21 was repeated in all essential details except that steel wool was substituted for the cotton. The product detonated when fired with a #6 cap.

EXAMPLE 23

The experiment of example 8 was repeated in all essential details except that two test containers were prepared that had the volume of glass bubbles such as to provide 3% of air based on the volume of the explosive charge. The first charge did not detonate with a #6 cap. The second container was boosted or primed with 25 grams of the explosive mixture of example 8. When the #6 cap detonated, the booster detonated, and the test charge detonated as a blasting agent.

EXAMPLE 24

The experiment of example 8 was repeated in all essential details except that the volume of glass bubbles was such as to provide 50% by volume of air based on the volume of nitromethane. The product detonated when fired with a #6 cap.

While the foregoing specification has discussed "air entrapment" and "air entrapment materials," it is understood that various other gases can be present instead of air. Thus, the term, "air entrapment," as used herein, is meant to include all compressable gases.

The term, "explosive composition," as used throughout this specification, is meant to broadly include cap sensitive explosive compositions that are sensitive to detonation by a #6 blasting cap, as well as blasting agents that must be boosted with other explosives. When explosive compositions of this invention are formulated with less volatile liquid combustible materials or when insufficient compressable gas is present, the explosive composition will not generally be cap sensitive and will, therefore, serve as a blasting agent that required boosting from another explosive.

Various changes and modifications may be made in the foregoing disclosure without departing from the spirit and scope of this invention.

I claim:

1. An explosive composition comprising an air entrapment material supported by and adhering to the surfaces of a solid component and a combustible liquid contacting the surfaces of at least a portion of said air entrapment material, said combustible liquid being capable of sustained combustion in air.

2. The composition of claim 1 wherein said air entrapment material is adhered to said solid component by means of an adhesive material that is insoluble in said combustible liquid.

3. The composition of claim 2 wherein said air entrapment material is present in an amount such that from about 1 to about 95 volume percent of the total composition is entrapped air.

4. The composition of claim 3 wherein said air entrapment material has air chambers of from about 1 micron up to about ¼ inch mean diameter.

5. The composition of claim 4 wherein the particle size of said air entrapment material is from about 10 microns up to about ¼ inch average particle diameter.

6. The composition of claim 5 wherein said combustible liquid includes at least one nitroalkane.

7. The composition of claim 6 wherein said nitroalkane is nitromethane.

8. The composition of claim 7 wherein said solid material is a particulate material having a mean particle diameter of up to about ¼ inch.

9. The composition of claim 8 wherein said air entrapment material is adhered to said solid material by a urethane adhesive.

10. The composition of claim 9 wherein said adhesive is present in an amount of from about 0.25 to about 15 percent by weight of the total composition.

11. The composition of claim 10 wherein said nitromethane is present in an amount of from about 3 to about 96 weight percent of the composition.

12. The composition of claim 11 wherein said solid material is ammonium nitrate.

13. The composition of claim 12 wherein said air entrapment material is glass microspheres.

14. The composition of claim 11 wherein said air entrapment material is glass microspheres.

15. The composition of claim 5 wherein said air entrapment material is glass microspheres.

16. The composition of claim 15 wherein said air entrapment material is present in an amount such that from about 5 to about 16 volume percent of the total composition is entrapped air.

17. The composition of claim 16 wherein said combustible liquid includes at least one nitroalkane.

18. The composition of claim 17 wherein said nitroalkane is nitromethane.

19. A method for providing an explosive composition comprising adhering an air entrapment material to the surfaces of a solid component and thereafter contacting the surfaces of at least a portion of said air entrapment material with a combustible liquid, said combustible liquid being capable of substained combustion in air.

20. An explosive composition comprising an air entrapment material supported by and adhering to the surfaces of a solid component selected from the group consisting of alkali metal nitrates, alkaline earth metal nitrates, ammonium nitrate and ammonium perchlorate and a combustible liquid contacting the surfaces of at least a portion of said air entrapment material, said combustible liquid being capable of sustained combustion in air and being an organic material which is liquid under atmospheric conditions at temperatures of from about 0° C to about 50° C, said adhering being carried out by means of an adhesive material that is insoluble in said combustible liquid.

21. The composition of claim 20 wherein said combustible materials comprise low molecular weight hydrocarbons, oxygen containing organic materials, nitrogen containing organic materials, halogenated organic materials and mixtures thereof.

22. The composition of claim 21 wherein said air entrapment material is present in an amount such that from about 1 to about 95 volume percent of the total composition is entrapped air.

23. The composition of claim 22 wherein said air entrapment material has air chambers of from about 1 micron up to about ¼ inch mean diameter.

24. The composition of claim 23 wherein the particle size of said air entrapment material is from about 10 microns up to about ¼ inch average particle diameter.

25. The composition of claim 24 wherein said combustible liquid includes at least one nitroalkane.

26. The composition of claim 25 wherein said nitroalkane is nitromethane.

27. The composition of claim 26 wherein said solid material is a particulate material having a mean particle diameter of up to about ¼ inch.

28. The composition of claim 27 wherein said air entrapment material is adhered to said solid material by a urethane adhesive.

29. The composition of claim 28 wherein said adhesive is present in an amount of from about 0.25 to about 15 percent by weight of the total composition.

30. The composition of claim 29 wherein said nitromethane is present in an amount of from about 3 to about 96 weight percent of the composition.

31. The composition of claim 30 wherein said solid material is ammonium nitrate.

32. The composition of claim 31 wherein said air entrapment material is glass microspheres.

33. The composition of claim 30 wherein said air entrapment material is glass microspheres.

34. The composition of claim 24 wherein said air entrapment material is glass microspheres.

35. The composition of claim 34 wherein said air entrapment material is present in an amount such that from about 5 to about 16 volume percent of the total composition is entrapped air.

36. The composition of claim 35 wherein said combustible liquid includes at least one nitroalkane.

37. The composition of claim 36 wherein said nitroalkane is nitromethane.

38. A method for producing an explosive composition comprising adhering an air entrapment material to the surfaces of a solid component selected from the group consisting of alkali metal nitrates, alkaline earth nitrates, ammonium nitrate and ammonium perchlorate and thereafter containing the surfaces of at least a portion of said air entrapment material with a combustible liquid, said combustible liquid being capable of sustained combustion in air and being an organic material which is a liquid under atmospheric conditions at temperatures of from about 0° C to about 50° C, said adhering being carried out by contacting said solid component and said air entrapment material with an adhesive material that is insoluble in said combustible liquid and mixing the solid component, the air entrapment material and adhesive material together.

* * * * *